US006418179B1

(12) United States Patent
Shieh

(10) Patent No.: US 6,418,179 B1
(45) Date of Patent: Jul. 9, 2002

(54) SCORE COUNTER BY SENSING ROUTE OF BASKETBALL SHOTS

(76) Inventor: Frank Shieh, 7F-1, No. 537, Sec. 2, Kuang-Fu Road, Hsinchu (TW)

( * ) Notice: Subject to any disclaimer, the term of this patent is extended or adjusted under 35 U.S.C. 154(b) by 0 days.

(21) Appl. No.: 09/861,734

(22) Filed: May 21, 2001

(51) Int. Cl.[7] ..... A63B 71/06
(52) U.S. Cl. ..... 377/5; 473/480; 473/485
(58) Field of Search ..... 377/5; 473/480, 473/485

(56) References Cited

U.S. PATENT DOCUMENTS 4,858,920 A * 8/1989 Best ..... 273/1.5 R

* cited by examiner

*Primary Examiner*—Margaret R. Wambach

(57) ABSTRACT

A score counter for sensing route of basketball shots includes a pair of photoelectric sensors installed at respective positions below an inner rim of a basket hoop to detect basketball valid shots. Such an arrangement overcomes basket net interference to the photoelectric sensors to avoid malfunctions and is capable of discriminating the correct route after a basketball is thrown into the basket hoop.

5 Claims, 4 Drawing Sheets

SCORE COUNTER BY SENSING ROUTE OF BASKETBALL SHOTS

FIELD OF THE INVENTION

This invention relates generally to basketball score counters, particularly to a basketball score counter, which counts basketball shots by using two sets of photoelectric sensors for sensing the route of basketball shots.

BACKGROUND OF THE INVENTION

For counting valid shots and scores during a basketball game, a sensing rod 11 in the form of a microswitch shown in FIG. 1 was disposed under a basket hoop 12 in such a way that a pitched basketball flying through the basket hoop 12 would be collided with the sensing rod 11 and judged by a score counter as a valid shot.

It is generally all right to sense valid shots with the above said microswitch under normal conditions. However, malfunctions of the score counter may occur in the case of a reverse throw or rebounds. Furthermore, the mechanical microswitch is inevitably getting elastically fatigue gradually or worn-out in the long run.

To overcome the above drawback, a sensing device equipped with a pair of photoelectric transmitting/receiving elements has been developed for sensing and judging basketball shots, as shown in FIG. 2, wherein a set of transmitting/receiving sensors 13 is arranged above or below the basket hoop 12 respectively. When a basketball is thrown into the basket hoop 12, a transmitter 131 of the set of transmitting/receiving sensors 13 projects light on the basketball and the light is reflected and received by a receiver 132 of the set of sensors 13, so that it is possible in this way to detect whether a basketball has been thrown into the basket hoop 12 or not. Nevertheless, the set of sensors 13 located below the basket hoop 12 may be interfered by the net 14 to reflect the transmitted light back to the receiver and cause the score counter to misjudge basketball shots.

SUMMARY OF THE INVENTION

The primary object of this invention is to provide a score counter by sensing the route of basketball shots, wherein a pair of photoelectric sensors is installed at respective positions below an inner rim of the basket hoop for detecting basketball valid shots. Such an arrangement is capable of overcoming the basket net interference to the photoelectric sensors for avoiding malfunctions and discriminating the correct route after a basketball is thrown into the basket hoop.

For more detailed information regarding advantages or features of this invention, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE INVENTION

Figure 1:
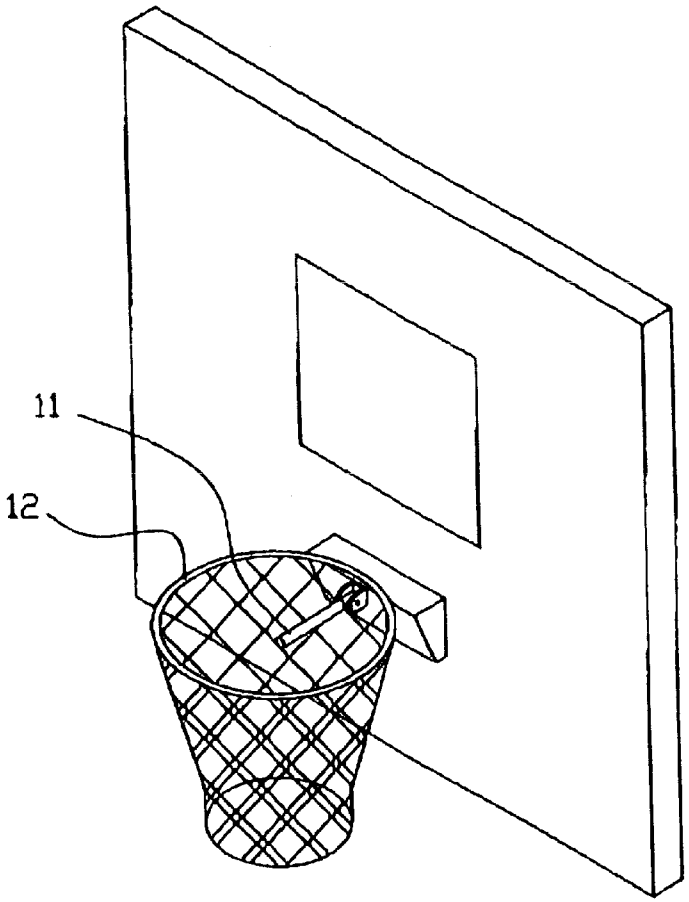
FIG. 1 is a conventional score counter for basketball game by using a micro switch.
Figure 2:
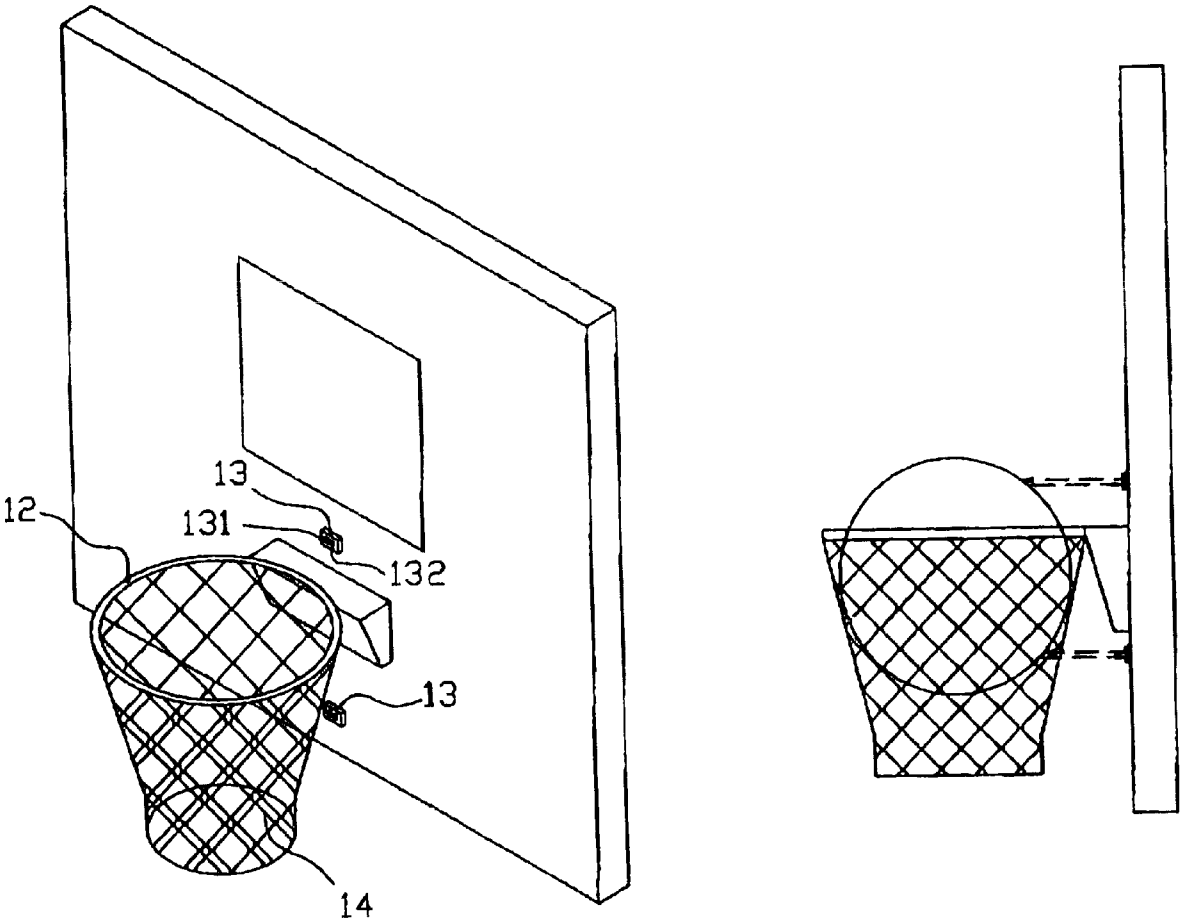
FIG. 2 is a schematic view of another conventional score counter for basketball game by using a pair of transmitting/receiving sensors.
Figure 3:
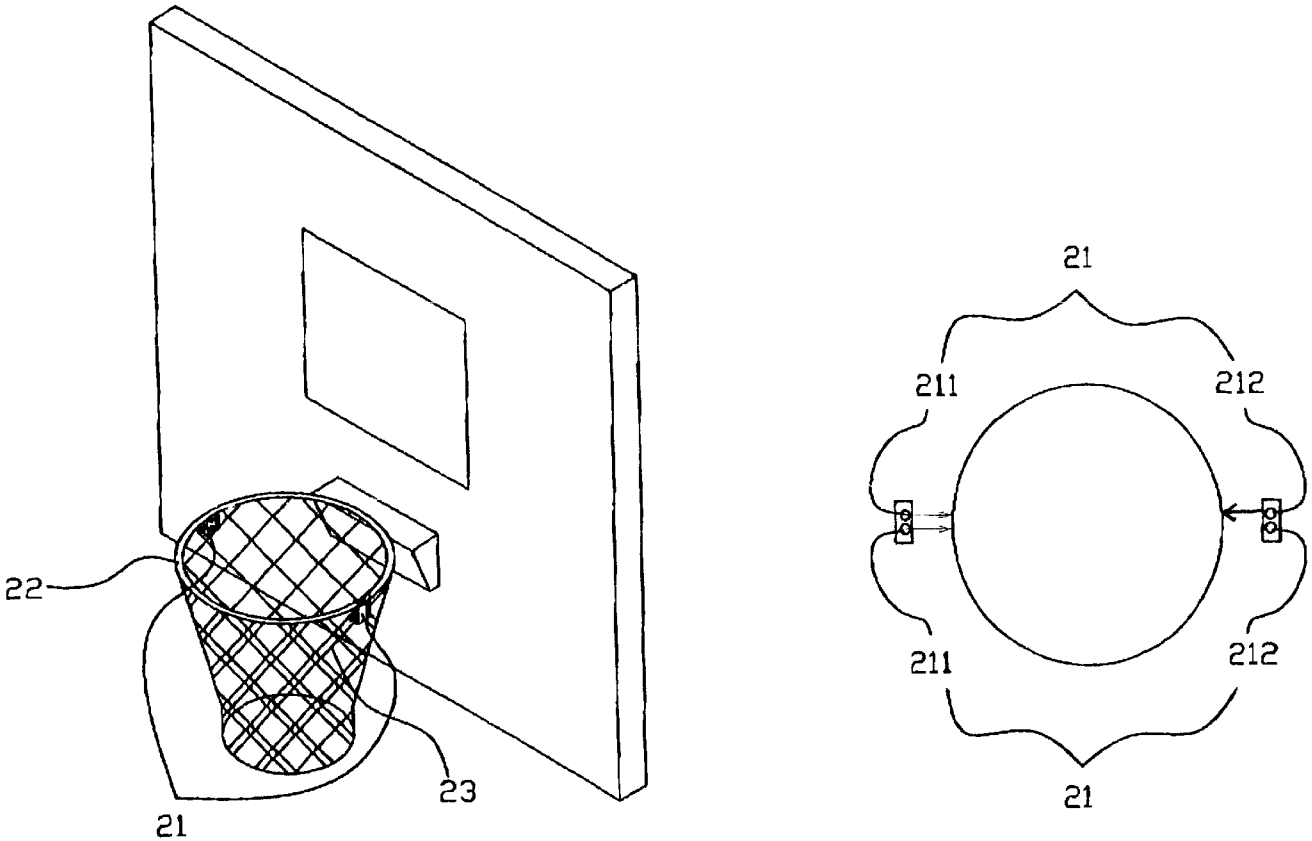
FIG. 3 is a score counter of this invention for basketball game by using a pair of transmitting/receiving sensors.
Figure 4:
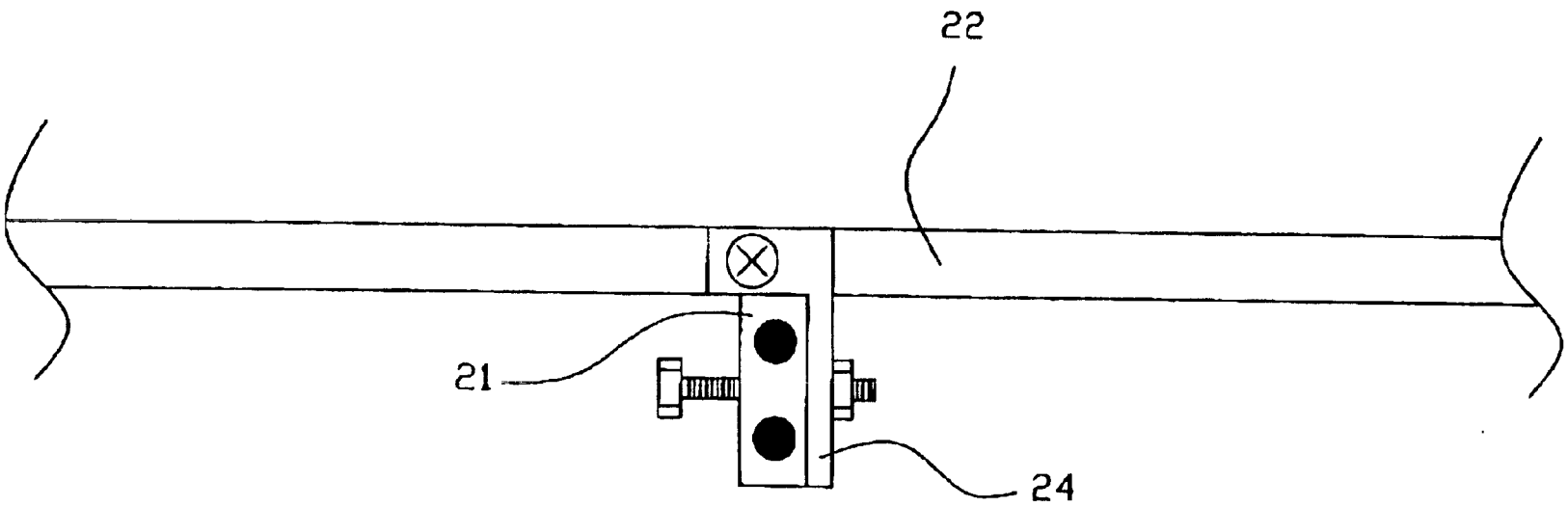
FIG. 4 is the score counter of this invention for basketball game by setting the paired transmitting/receiving sensors under a basket hoop.

As indicated in FIG. 3, a basketball score counter of this invention comprises two sets of photoelectric sensors 21 which are disposed at respective diametrically opposite positions under the inner circle of a basket hoop 22 for judging whether a basketball shot gets its score or not. When a basketball flies into the basket hoop 22, light propagation between a photo emitter 211 and a photo receiver 212 of the photoelectric sensor 21 is interrupted by the basketball in the basket hoop 22 to allow the score counter to determine if it is a valid shot. Under general conditions, malfunction of the score counter is avoidable because the photoelectric sensors 21 won't be interfered by the basket net. Moreover, if those two sets of photoelectric sensors 21 are arranged vertically in different heights, further analysis can be done from the sensor signals to determine if the basketball actually drops downwards to make a valid shot or it arises upward to become a false shot. As shown in FIG. 4, the preferred embodiment of this invention has a photo emitter located directly below another photo emitter. Similarly, a photo receiver is also disposed directly below another photo receiver.

For installing the photoelectric sensors 21 under the basket hoop 22, a scarf-joint board may be applied. One end of the scarf-joint board is secured at the basket hoop and the other end is used for anchoring the photoelectric sensors. As illustrated in a preferred embodiment of FIG. 4, one end of an L-shaped scarf-joint board 24 is fixed on the basket hoop 22 and the other is provided with the photoelectric sensors 21.

In the above described, at least one preferred embodiment has been described in detail with reference to the drawings annexed, and it is apparent that numerous variations or modifications may be made without departing from the true spirit and scope thereof, as set forth in the claims below.

What is claimed is:

1. A basketball score counter comprising:

first and second photo emitters fixed on a first location of a basket hoop;

first and second photo receivers fixed on a second location of said basket hoop diametrically opposite to said first location;

a first scarf-joint board having a first end on which said photo emitters are mounted and a second end anchored on said first location of said basket hoop; and a second scarf-joint board having a first end on which said photo receivers are mounted and a second end anchored on said second location of said basket hoop;

wherein said first and second photo receivers sense light signals from said first and second photo emitters respectively for determining if a basketball shot is valid or not.

2. The basketball score counter as claimed in claim 1, wherein said first and second scarf-joint boards are L-shaped.

3. A basketball score counter comprising:

first and second photo emitters fixed on a first location of a basket hoop, said second photo emitter being located vertically below said first photo emitter; and first and second photo receivers fixed on a second location of said basket hoop diametrically opposite to said first location, said second photo receiver being located vertically below said first photo receiver;

wherein said first and second photo receivers sense light signals from said first and second photo emitters respectively for determining if a basketball shot is valid or not.

4. The basketball score counter as claimed in claim 3, further comprising:

a first scarf-joint board having a first end on which said photo emitters are mounted and a second end anchored on said first location of said basket hoop; and a second scarf-joint board having a first end on which said photo receivers are mounted and a second end anchored on said second location of said basket hoop.

5. The basketball score counter as claimed in claim 4, wherein said first and second scarf-joint boards are L-shaped.

* * * * *